US009626929B2

(12) United States Patent
Yusa

(10) Patent No.: US 9,626,929 B2
(45) Date of Patent: Apr. 18, 2017

(54) LIQUID CRYSTAL PANEL DRIVING APPARATUS

(75) Inventor: Atsushi Yusa, Tokyo (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 2470 days.

(21) Appl. No.: 12/333,441

(22) Filed: Dec. 12, 2008

(65) Prior Publication Data

US 2009/0153541 A1 Jun. 18, 2009

(30) Foreign Application Priority Data

Dec. 12, 2007 (JP) ..... 2007-321031

(51) Int. Cl.
*G06F 3/038* (2013.01)
*G09G 3/36* (2006.01)

(52) U.S. Cl.
CPC ..... *G09G 3/3685* (2013.01); *G09G 2330/08* (2013.01)

(58) Field of Classification Search
CPC ..... G09G 2330/08
USPC ..... 345/98–99, 103
See application file for complete search history.

(56) References Cited

U.S. PATENT DOCUMENTS

| | | | | |
|---|---|---|---|---|
| 5,057,928 | A * | 10/1991 | Nagashima et al. | 348/793 |
| 5,844,540 | A * | 12/1998 | Terasaki | 345/102 |
| 2005/0035958 | A1* | 2/2005 | Moon | 345/204 |
| 2006/0197730 | A1* | 9/2006 | Ooga et al. | 345/98 |
| 2006/0256063 | A1* | 11/2006 | An | 345/98 |
| 2007/0085799 | A1* | 4/2007 | Hong et al. | 345/94 |

FOREIGN PATENT DOCUMENTS

JP 2006-243565 A 9/2006

* cited by examiner

*Primary Examiner* — Chanh Nguyen
*Assistant Examiner* — Yuzhen Shen
(74) *Attorney, Agent, or Firm* — Taft Stettinius & Hollister LLP; Anthony P. Filomena, II

(57) ABSTRACT

A liquid crystal panel driving apparatus that produces a normal display without damaging the liquid crystal panel even when each of a plurality of timing controllers receives an abnormal display data signal. In an exemplary apparatus, each of the timing controllers transmits an abnormality detection signal, which is generated by detecting an abnormality in the display data signal, to other timing controllers via an abnormality detection line, and each of the timing controllers outputs image data associated with the abnormality detection signal stored in an image data memory.

7 Claims, 4 Drawing Sheets

LIQUID CRYSTAL PANEL DRIVING APPARATUS

CROSS REFERENCE TO RELATED APPLICATION

This application claims the benefit of Japanese Patent Application No. 2007-321031, filed Dec. 12, 2007, which is incorporated by reference.

BACKGROUND

The present disclosure relates to a liquid crystal panel driving apparatus and, more particularly, to a liquid crystal panel driving apparatus including a plurality of timing controllers.

A conventional liquid crystal driving apparatus, which drives a high resolution liquid crystal panel using a plurality of timing controllers and allows a large amount of display data can be transmitted at lowered the transmission rates, is known. FIG. 4 is a block diagram of a conventional liquid crystal panel and a liquid crystal driving apparatus. A graphic processor 300C provides a timing controller 100C with a display data signal DD1C, and provides a timing controller 200C with a display data signal DD2C. The timing controller 100C provides each of source drivers 410C-1 to 410C-N (where N is a positive integer) with a source driver control signal SD1C and an image data signal PD1C based on the display data signal DD1C. In addition, the timing controller 100C provides each of gate drivers 510C-1 to 510C-M (where M is a positive integer) with a gate driver control signal GD1C based on the display data signal DD1C. The source drivers 410C-1 to 410C-N and the gate drivers 510C-1 to 510C-M drive a liquid crystal panel 600C in accordance with the source driver control signal SD1C, the image data signal PD1C, and the gate driver control signal GD1C received from the timing controller 100C. The timing controller 200C, the source drivers 420C-1 to 420C-N, and the gate drivers 520C-1 to 520C-M operate in a substantially similar manner using the source driver control signal SD2C, the image data signal PD2C, and the gate driven control signal GD2C.

In the configuration as shown in FIG. 4, the timing controller 100C and the timing controller 200C usually operate independently from each other. In some devices, the timing controller 100C has an alarm function in order to protect the liquid crystal panel 600C when the display data signal DD1C is abnormal, and, similarly, the timing controller 200C has an abnormality display function in order to protect the liquid crystal panel 600C when the display data signal DD2C is abnormal. In such a configuration, the normal and the abnormal signals are displayed together at the same time, for example, in the case where only the display data signal DD1C is abnormal. Furthermore, when the control timing of the gate drivers 510C-1 to 510C-M according to the timing controller 100C and the control timing of the gate drivers 520C-1 to 520C-M according to the timing controller 200C are different from each other, there is a possibility that the gate drivers 510C-1 to 510C-M, the gate drivers 520C-1 to 520C-M, and the liquid crystal panel 600C may be damaged.

Japanese Laid-Open Patent Application Publication No. 2006-243565, which is incorporated by reference, discloses a method of driving a display panel using a plurality of timing controllers. In particular, when one of the timing controllers detects an abnormality in the display control, the timing controller informs the other timing controller of the detection result, and then damage to the display panel can be prevented by the normal display control by transmission of normal image data and a normal clock signal to one of the timing controllers by the other controller.

However, Japanese Laid-Open Patent Application Publication No. 2006-243565 does not provide a description of the case where each of a plurality of the timing controllers simultaneously receives abnormal display data, and no specific circuit configuration to cope with this situation is disclosed. Further, there is no description of a countermeasure to the case where abnormal display data different between the timing controllers are inputted. For example, there is no description of a case in which a display data signal missing a clock signal is provided to one of the timing controllers, and a display data signal missing a synchronization signal is provided to the other timing controller. Consequently, the display panel driving method disclosed in Japanese Laid-Open Patent Application Publication No. 2006-243565 has a problem that the normal signal and the abnormal signal are displayed together at the same time in the case where each of the plurality of timing controllers simultaneously receives the abnormal display data. Additionally, there is no description of synchronization between image display timing of the plurality of the timing controllers, and there is a problem that the liquid crystal panel may be damaged due to unsynchronized gate-driver control timing between the timing controllers.

INTRODUCTION

The present disclosure has been made in consideration of the above-mentioned situation, and an object is to provide a liquid crystal panel driving apparatus having a capability of displaying normally even when each of a plurality of timing controllers receives abnormal display data signals.

An exemplary liquid crystal panel includes a plurality of timing controllers, each of which includes a line memory for storing image data included in received display data, and an output control unit for providing a liquid crystal panel with a driving signal based on the image data in the line memory and the display data signal. Each of the timing controllers includes an abnormality detection unit for outputting an abnormality detection signal when an abnormality in the display data signal is detected, an abnormality detection signal transmission unit for transmitting the abnormality detection signal to other timing controllers, an image data memory for storing image data associated with the abnormality detection signal, and an image switching unit for providing the output control unit with the image data associated with the abnormality detection signal in the image data memory instead of the image data in the line memory.

In an aspect, the abnormality detection signal transmission unit includes an open drain circuit including a gate input, a drain output and a source common connected to a reference voltage. The gate input may be adapted to receive the abnormality detection signal. The drain output may be adapted to transmit the abnormality detection signal to at least one other of the timing controllers via an abnormality detection line which is connected to a pull-up resistor. In another aspect, the drain output of the drain output circuit included in one of the timing controllers and the drain output of the drain output circuit included in another one of the timing controllers are connected to each other through the abnormality detection line connected to the pull-up resistor.

In another aspect, the output control unit provides the liquid crystal panel driver with the image data synchronized with a clock signal included in the display data signal. The abnormality detection signal includes a clock abnormality detection signal for indicating a detection of an abnormality in the clock signal and a synchronization abnormality detection signal for indicating a detection of an abnormality in a synchronization signal. Also, the image switching unit provides the output control unit with the clock abnormality detection signal with the image data associated with the abnormality detection signal upon receiving one or both of the clock abnormality detection signal and the synchronization detection signal.

In yet another aspect, each of the timing controllers includes a clock switching unit operative to select an internal clock signal instead of the clock signal included in the display data signal upon receipt of the clock abnormality detection signal. Further, the output control unit provides the liquid crystal panel driver with the image data associated with the abnormality detection signal synchronized with the internal clock signal.

In still yet another aspect, the image switching unit includes a start signal generating circuit operative to generate a start signal, a start signal transmitting circuit operative to transmit the start signal to another of the timing controllers, and the output control unit starts to provide the liquid crystal panel driver with the image data upon receipt of the start signal.

In yet another aspect, a liquid crystal driving apparatus may also include a selector for selecting any one of a start signal generated by the image-switching unit included in the timing controller generating the start signal or start signals received from another timing controller. The output control unit starts to provide the image data upon receipt of the start signal selected by the selector.

BRIEF DESCRIPTION OF THE DRAWINGS

The above and other objects and features will become apparent from the following detailed description, with reference to the accompanying drawings, wherein.

DETAILED DESCRIPTION

Figure 1:
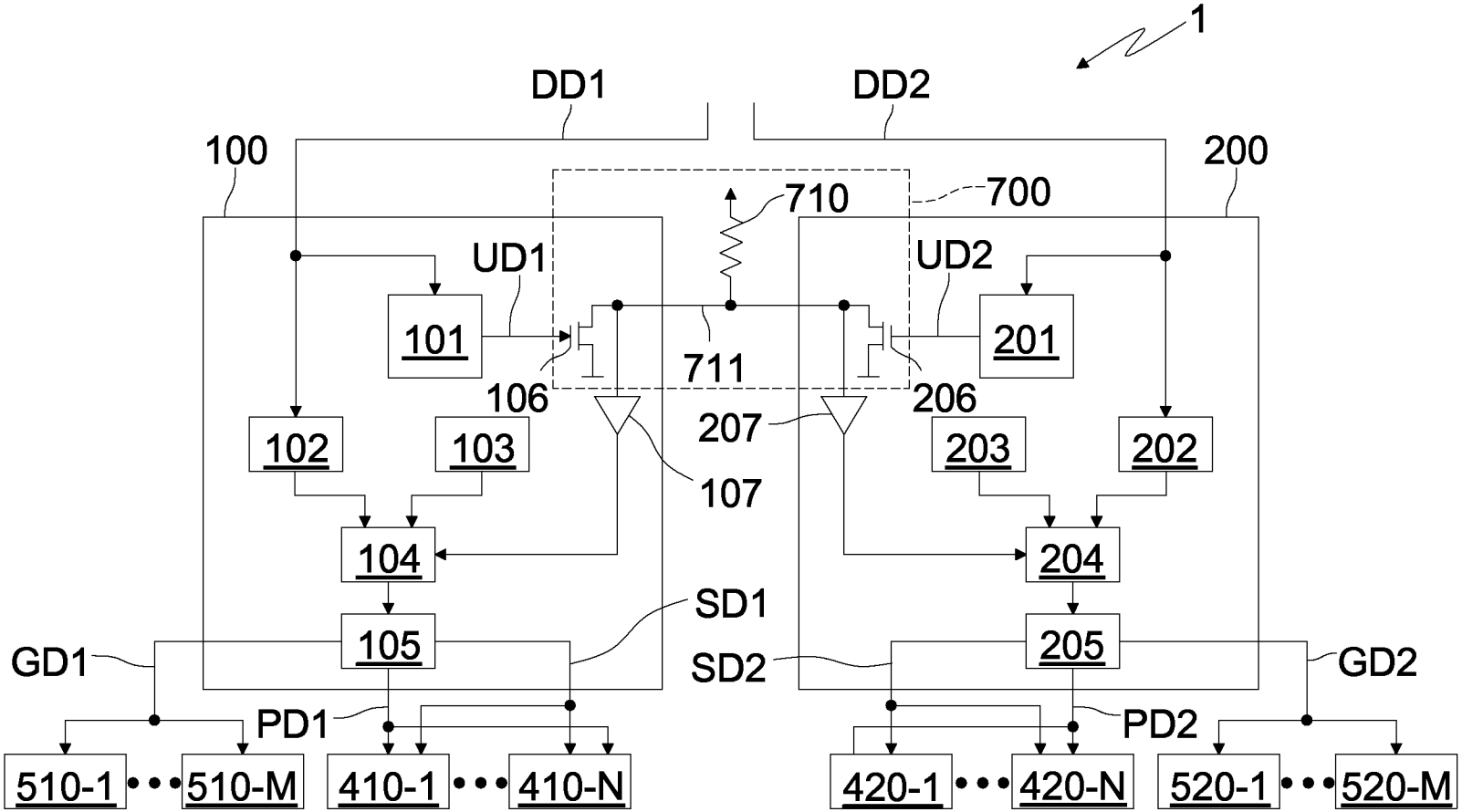
FIG. 1 is a block diagram showing a liquid crystal panel driving apparatus according to a first exemplary embodiment.

FIG. 1 is a block diagram showing a liquid crystal panel driving apparatus 1 according to a first exemplary embodiment. The liquid crystal panel driving apparatus 1 drives a liquid crystal panel and includes timing controllers 100, 200, source drivers 410-1 to 410-N and 420-1 to 420-N (where N is a positive integer), and gate drivers 510-1 to 510-M and 520-1 to 520-M (where M is a positive integer).

The timing controller 100 receives a display data signal DD1 from a graphic processor and provides each of the source drivers 410-1 to 410-N with a source driver control signal SD1 and an image data signal PD1 based on the display data signal DD1, and also provides each of the gate drivers 510-1 to 510-M with a gate driver control signal GD1 based on the display data signal DD1.

Each of the source drivers 410-1 to 410-N is a liquid crystal panel driver and drives the liquid crystal panel based on the source driver control signal SD1 and the image data signal PD1 from the timing controller 100. Also, each of the gate drivers 510-1 to 510-M is a liquid crystal panel driver, and drives the liquid crystal panel based on the gate driver control signal GD1 from the timing controller 100.

The timing controller 100 includes an abnormality detection unit 101, a line memory 102, an image data memory 103, an image switching unit 104, an output control unit 105, an open-drain output circuit 106 (which is part of an abnormality detection signal transmission unit 700), and a buffer 107.

The abnormality detection unit 101 receives the display data signal DD1 from the graphic processor and detects abnormalities in the display data signal DD1. For example, the abnormality detection unit 101 determines that the display data signal DD1 is abnormal when a clock signal or a synchronization signal normally included in the display data signal DD1 is not present. The abnormality detection unit 101 outputs an abnormality detection signal UD1 when an abnormality in the display data signal DD1 is detected. Normally, the abnormality detection unit 101 outputs a low level signal (i.e., when no abnormality is detected). The abnormality detection unit 101 outputs a high level abnormality detection signal UD1 when an abnormality is detected.

The line memory 102 receives the display data signal DD1 from the graphic processor and stores the images.

The image data memory 103 stores image data associated with the abnormality detection signal which is displayed on the liquid crystal panel when an abnormality occurs in the display data signal DD1 and/or the display data signal DD2.

The image-switching unit 104 normally provides the output control unit 105 with the image data stored in the line memory 102 (i.e., when the abnormality detection signal UD1 is not active). In addition, the image switching unit 104 provides the output control unit 105 with the image data associated with the abnormality detection signal stored in the image data memory 103 instead of the image data stored in the line memory 102 upon activation of the abnormality detection signal UD1. In this exemplary embodiment, the image switching unit 104 provides the output control unit 105 with the image data stored in the line memory 102 when a high level signal is inputted to a switching-control input terminal of the image switching unit 104, and the image switching unit 104 provides the output control unit 105 with the image data associated with the abnormality detection signal stored in the image data memory 103 when a low level signal is inputted to the switching-control input terminal of the switching unit 104.

The output control unit 105 provides each of the source drivers 410-1 to 410-N with the source driver control signal SD1 and the image data signal PD1 generated based on the normal image data or the image data associated with the abnormality detection signal from the image switching unit 104, and simultaneously provides each of the gate drivers 510-1 to 510-M with the gate driver control signal GD1.

A gate input of the open drain output circuit 106 is connected to an output of the abnormality detection unit 101 and receives the abnormality detection signal UD1 from the abnormality detection unit 101. Normally, when the low level signal from the abnormality detection unit 101 is inputted to the gate input, a path between the drain and the source is not conductive. When an abnormality is detected, the high level signal of the abnormal detection signal UD1 is inputted to the gate input, and the path between the drain and the source is conductive. A source common of the open drain output circuit 106 is connected to a reference voltage (such as ground).

A drain output of the open drain output circuit 106 is connected to one end of an abnormality detection line 711, which is connected to a pull-up resistor 710. The pull-up resistor 710 is placed on a board or a substrate to which the timing controller 100 is mounted. One end of the pull-up resistor 710 is connected on the abnormality detection line 711 and the other end of the pull-up resistor 710 is connected to a power supply layer having a high level voltage. The other end of the abnormality detection line 711 is connected to a drain output of an open drain output circuit 206 included in timing controller 200. Also, the drain output of the open drain output circuit 106 is connected to the switching-control input terminal of the image-switching unit 104 through the buffer 107.

The timing controller 200 has the same configuration as the timing controller 100 and performs the same functions. Specifically, timing controller 200 includes an abnormality detection unit 201, a line memory 202, an image data memory 203, an image switching unit 204, an output control unit 205, an open drain output circuit 206, and a buffer 207. Similarly, source drivers 420-1 to 420-N and the gate drivers 520-1 to 520-M perform the same functions as the source drivers 410-1 to 410-N and the gate drivers 510-1 to 510-M.

An exemplary operation of the liquid crystal driving apparatus 1 when the display data signal DD1 from the graphic processor is abnormal and the display data signal DD2 is normal is described. First, when the abnormality detection unit 101 determines that the display data signal DD1 is not abnormal (i.e., is normal), the gate input of the open drain output circuit 106 is provided with the low level signal and the path between the drain and the source of the open drain output circuit 106 is not conductive. Similarly, the abnormality detection unit 201 determines that the display data signal DD2 is normal, the gate input of the open drain output circuit 206 is provided with the low level signal, and the path between the drain and the source of the open drain output circuit 206 is not conductive. Accordingly, since the pull-up resistor 710 is connected to the high level voltage, the high level signal is provided to both of the switching-control input terminals of image switching units 104 and 204.

The abnormality detection unit 101 generates the abnormality detection signal UD1 having the high level when an abnormality in the display data signal DD1 is detected. The abnormality detection signal UD1 is provided to the gate input of the open drain output circuit 106 and the path between the drain and the source of the open drain output circuit 106 is conductive. Since the source common is connected to the reference voltage, the low level signal is provided to the switching control input terminal of the image-switching unit 104 through the buffer 107, and is also provided to the switching control input terminal of the image-switching unit 204 through the abnormality detection line 711 and buffer 207. Meanwhile, since the abnormality detection unit 201 continues to determine that the display data signal DD2 is normal and does not generate the abnormality detection signal UD2 having the high level, the path between the drain and the source of the open drain output circuit 206 is not conductive.

The image-switching unit 104 provides the output control unit 105 with the image data associated with the abnormality detection signal stored in the image data memory 103 instead of the image data stored in the line memory 102 upon receiving the low level signal provided to the switching control input terminal of the image-switching unit 104. Similarly, the image-switching unit 204 provides an output control unit 205 with the image data associated with the abnormality detection signal stored in an image data memory 203 instead of the image data stored in a line memory 202 upon receiving the low level signal provided to the switching control input terminal of the image-switching unit 204.

The output control unit 105 provides each of the source drivers 410-1 to 410-N with the source driver control signal SD1 and the image data signal PD1 generated based on the image data associated with the abnormality detection signal from the image switching unit 104, and also provides each of the gate drivers 510-1 to 510-M with the gate driver control signal GD1. The output control unit 205 performs generally the same process as the output control unit 105.

Thus, the problem with conventional devices in which the abnormal signal and the normal signal are displayed together because both of the timing controllers 100, 200 output the image data associated with the abnormality detection signal even when only the display data signal DD1 to the timing controller 100 is abnormal, thus avoiding damage to the liquid crystal panel.

When both of the display data signals DD1, DD2 are abnormal, the abnormality detection unit 101 generates the abnormality detection signal UD1 having the high level by detecting the abnormal display data signal DD1, and the abnormality detection unit 201 generates the abnormality detection signal UD2 having the high level by detecting the abnormal display data signal DD2. Thus, the paths between the drains and the sources of both of the open drain output circuits 106, 206 become conductive. The low level signal is provided to the switching control input signal terminal of the image-switching unit 104 (through the buffer 107) and is also provided to the switching control input signal terminal of the image-switching unit 204 (through the buffer 207).

The image-switching unit 104 provides the output control unit 105 with the image data associated with the abnormality detection signal stored in the image data memory 103 instead of the image data stored in the line memory 102 upon receiving the low level signal provided to the switching control input terminal of the image-switching unit 104. Similarly, the image-switching unit 204 provides an output control unit 205 with the image data associated with the abnormality detection signal stored in an image data memory 203 instead of the image data stored in a line memory 202 upon receiving the low level signal provided to the switching control input terminal of the image-switching unit 204. The output control units 105 and 205 operate as described above.

Thus, the problem of the related art, wherein the abnormal signal and the normal signal are displayed together is solved because both of the timing controllers 100, 200 output the image data associated with the abnormality detection signal even when both the display data signal DD1 to the timing controller 100 and the display data signal DD2 to the timing controller 200 are abnormal, thus avoiding damage to the liquid crystal panel.

Furthermore, since the abnormality detection signal transmission unit 700 can be configured by connecting the timing controllers 100, 200 using the abnormality detection line 711 and mounting the pull-up resistor 710 connected to the abnormality detection line 711 on the board or the substrate to which the timing controllers 100, 200 are mounted, a normal display can be realized with a minimal increase in the area of the board or the substrate and the cost thereof.

Figure 2:
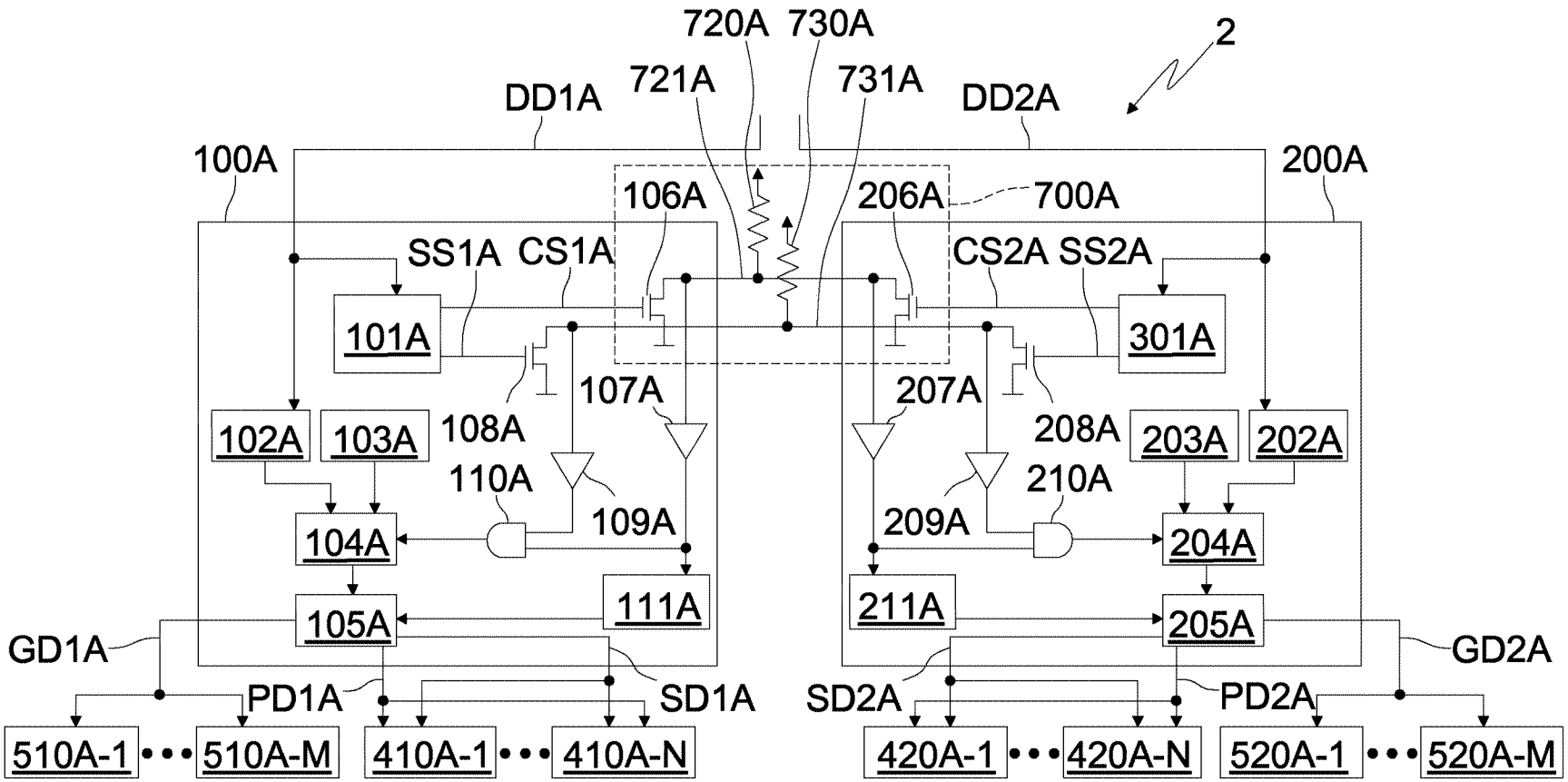
FIG. 2 is a block diagram showing a liquid crystal panel driving apparatus according to a second exemplary embodiment.

FIG. 2 is a block diagram showing a liquid crystal driving apparatus 2 according to a second exemplary embodiment. In this exemplary embodiment, the abnormality detection unit 101A receives the display data signal DD1A from the graphic processor and detects abnormalities in the clock signal and the synchronization signal included in the display data signal DD1A. The abnormality detection unit 101A outputs a clock abnormality detection signal CS1A having a high level when an abnormality in the clock signal is detected. Also, the abnormality detection unit 101A outputs a synchronization abnormality detection signal SS1A having a high level when an abnormality in the synchronization signal is detected. Normally, when no abnormalities are detected in the display data signal DD1A, the abnormality detection unit 101A continues to output the low level signal.

The gate input of the open drain output circuit 106A is connected to the output of the abnormality detection unit 101A and receives the clock abnormality detection signal CS1A from the abnormality detection unit 101A. Normally, the low level signal is inputted to the gate input from the abnormality detection unit 101A, and the path between the drain and the source is not conductive. When a clock signal abnormality is detected, the clock abnormality detection signal CS1A having the high level is inputted to the gate input, and the path between the drain and the source becomes conductive. In addition, the source common of the open drain output circuit 106A is connected to the reference voltage (such as ground).

The drain output of the open drain output circuit 106A is connected to one end of a clock abnormality detection line 721A connected to a pull-up resistor 720A. The pull-up resistor 720A is placed on a board or a substrate to which the timing controller 100A is mounted. One end of the pull-up resistor 720A is connected to the abnormality detection line 721A and the other end is connected to a power supply layer on the board or the substrate having the high level voltage. The other end of the clock abnormality detection line 721A is connected to a drain output of an open drain output circuit 206A included in the timing controller 200A. The drain output of the open drain output circuit 106A is connected to an input of an AND circuit 110A via the buffer 107A. Also, the drain output of the open drain output circuit 106A is connected to a clock-switching unit 111A via the buffer 107A.

A gate input of an open drain output circuit 108A is connected to the output of the abnormality detection unit 101A and receives the synchronization abnormality signal SS1A from the abnormality detection unit 101A. Normally, the gate input is provided with a low level signal, and the path between the drain and the source is not conductive. When an abnormality in the synchronization signal is detected, the gate input is provided with a synchronization abnormality detection signal SS1A having a high level, and the path between the drain and the source becomes conductive. In addition, the source common of the open drain output circuit 108A is connected to the reference voltage (such as ground).

The drain output of the open drain output circuit 108A is connected to one end of a synchronization abnormality detection line 731A connected to a pull-up resistor 730A. The pull-up resistor 730A is placed on the board or the substrate to which the timing controller 100A is mounted. One end of the pull-up resistor 730A is connected to the abnormality detection line 731A and the other end is connected to a power supply layer having the high level voltage on the board or the substrate. The other end of the synchronization abnormality detection line 731A is connected to a drain output of an open drain output circuit 208A included in timing controller 200A. Also, the drain output of the open drain output circuit 108A is connected to an input of an AND circuit 110A via the buffer 109A.

One of the inputs of the AND circuit 110A is connected to the output of the buffer 107A and the other input is connected to the output of the buffer 109A. The output of the AND circuit 110A is connected to the switching control input terminal of the image switching unit 104A.

The clock-switching unit 111A includes an internal clock generating circuit that generates an internal clock signal. The clock-switching unit 111A provides the output control unit 105A with the internal clock signal instead of the clock signal included in the display data signal DD1A upon receiving the clock abnormality detection signal CS1A.

Normally, the output control unit 105A provides the source drivers 410A-1 to 410A-N with the source driver control signal SD1A and the image data signal PD1A, and provides the gate drivers 510A-1 to 510A-M with the gate driver control signal GD1A, synchronized with the clock signal included in the display data signal DD1A. If an abnormality is detected, the output control unit 105A provides the source drivers 410A-1 to 410A-N and the gate drivers 510A-1 to 510A-M with the above-described signals, synchronized with the internal clock signal from clock-switching unit 111A.

Timing controller 200A has the same configuration as timing controller 100A, and performs the same process as timing controller 100A. Open drain output circuit 206A and open drain output circuit 208A are included in timing controller 200A.

When the synchronization signal included in the display data signal DD1A from graphic processor is abnormal and the clock signal is normal, the abnormality detection unit 101A detects the synchronization abnormality in the display data signal DD1A and generates the synchronization abnormality signal SS1A having a high level. The synchronization abnormality signal SS1A is inputted to the gate input of the open drain output circuit 108A, and the path between the drain and the source becomes conductive. Since the source common is connected to the reference voltage, the low level signal is provided to one of the inputs of the AND circuit 110A via the buffer 109A, and also provided to one of the inputs of an AND circuit 210A via a synchronization abnormality detection line 731A and a buffer 209A.

Since the abnormality detection unit 101A determines that the clock signal included in the display signal data DD1A is normal and does not generate the clock abnormality detection signal CS1A having the high level signal, the path between the drain and the source of the open drain output circuit 106A is not conductive. Because one end of the pull-up resistor 720A is connected to the power supply layer having the high level, the other input of the AND circuit 110A is provided with the high level signal via buffer 107A, and one input of the other AND circuit 210A is provided with the high level signal via buffer 207A.

The clock switching unit 111A selects the clock signal included in the display data signal DD1A corresponding to the high level signal input from buffer 107A, and provides the output control unit 105A with the selected clock signal. Similarly, a clock switching unit 211A selects the clock signal included in a display data signal DD2A corresponding to the high level signal input from buffer 207A, and provides an output control unit 205A with the selected clock signal.

Since one of inputs of the AND circuit 110A is provided with the high level signal from the buffer 107A, and the other input is provided with the low level signal from the buffer 109A, the AND circuit 110A provides the image switching unit 104A with the low level signal. Similarly, the AND circuit 210A provides image switching unit 204A with the low level signal.

The image-switching unit 104A provides the output control unit 105A with the image data associated with the abnormality detection signal stored in the image data memory 103A instead of the image data stored in the line memory 102A upon receiving the low level signal provided to the switching control input terminal of the image-switching unit 104A. Similarly, the image-switching unit 204A provides the output control unit 205A with the image data associated with the abnormality detection signal stored in an image data memory 203A instead of the image data stored in a line memory 202A upon receiving the low level signal provided to the switching control input terminal of the image-switching unit 204A.

The output control unit 105A provides each of the source drivers 410A-1 to 410A-N with the source driver control signal SD1A and the signal PD1A related to image data associated with the abnormality detection signal, and provides each of the gate drivers 510A-1 to 510A-M with the gate driver control signal GD1A, synchronized with the clock signal included in the display data signal DD1A. The output control unit 205A performs the same functions as the output control unit 105A.

Thus, the timing controller 100A outputs the signal PD1A related to image data associated with the abnormality detection signal synchronized with the clock signal included in the display data signal DD1A when the synchronization signal included in the display data signal DD1A is abnormal and the clock signal is normal. Since the abnormality of the synchronization signal is transmitted to the timing controller 200A through the synchronization abnormality detection line, the timing controller 200A can also output the signal PD2A related to image data associated with the abnormality detection signal synchronized with the clock signal included in the display data signal DD2A.

When the clock signal included in the display data signal DD1A from the graphic processor is abnormal and the synchronization signal is normal or abnormal, the abnormality detection unit 101A detects the clock abnormality in the display data signal DD1A and generates the clock abnormality detection signal CS1A having the high level. The clock abnormality detection signal CS1A is inputted to the gate input of the open drain output circuit 106A, and the path between the drain and the source becomes conductive. Since the source common is connected to the reference voltage, the low level signal is provided to the one of the inputs of the AND circuit 110A through the buffer 107A and is also provided to one of the inputs of the AND circuit 210A through the abnormality detection line 721A and the buffer 207A. After the abnormality detection unit 101A determines the normality or the abnormality of the synchronization signal, the high or low level signal is provided to the other input of the AND circuit 110A via buffer 109A, and the high or low level signal is provided to the input of AND circuit 210A via buffer 209A.

In addition, the clock-switching unit 111A selects the internal clock signal upon receiving the low-level signal input from the buffer 107A, and provides the output control unit 105A with the internal clock signal. Similarly, the clock-switching unit 211A selects the internal clock signal upon receiving the low-level signal input from the buffer 207A, and provides the output control unit 205 with the internal clock signal.

Since one of the inputs of the AND circuit 110A is provided with the low level signal from the buffer 107A, the output of the AND circuit 110A provides the image switching unit 104A with the low level signal. Similarly, the output of the AND circuit 210A provides the image switching unit 204A with the low level signal.

The image-switching unit 104A provides the output control unit 105A with the image data associated with the abnormality detection signal stored in the image data memory 103A upon receiving the low level signal provided to the switching control input terminal of the image-switching unit 104A. Similarly, the image-switching unit 204A provides the output control unit 205A with the image data associated with the abnormality detection signal stored in the image data memory 203A upon receiving the low level signal provided to the switching control input terminal of the image-switching unit 204A.

The output control unit 105A provides each of the source drivers 410A-1 to 410-N with the source driver control signal SD1A and the signal PD1A related to image data associated with the abnormality detection signal, and also provides each of the gate drivers 510A-1 to 510A-M with the gate driver control signal GD1A, synchronized with the internal clock. The output control unit 205A performs the generally same functions as the output control unit 105A.

Thus, the timing controller 100A outputs the signal PD1A related to image data associated with the abnormality detection signal synchronized with the internal clock generated by the clock switching unit when the clock signal included in the display data signal DD1A is abnormal. Since the abnormality of the synchronization signal is transmitted to the timing controller 200A through the synchronization abnormality detection line 731A, the timing controller 200A can also output the signal PD2A related to image data associated with the abnormality detection signal synchronized with the internal clock generated by the clock switching unit 211A.

Generally the same process is performed when the display data signal DD2A to the timing controller 200A includes an abnormality.

Because the liquid crystal driving apparatus 2 of the second exemplary embodiment separately detects abnormalities in the clock signal and the synchronization signal included in the display data signal DD1A, the liquid crystal driving apparatus 2 outputs the signal related to image data associated with the abnormality detection signal synchronized with the clock when the synchronization signal is determined to be abnormal and the clock signal is determined to be normal. The liquid crystal driving apparatus 2 outputs the signal related to image data associated with the abnormality detection signal synchronized with the internal clocks 111A, 211A the clock signal is determined to be abnormal. Since the liquid crystal driving apparatus 2 includes the clock abnormality detection line 721A for transmitting the clock abnormality and the synchronization abnormality detection line 731A for transmitting the synchronization abnormality, and each of the abnormalities is transmitted to other timing controllers, both of the timing controllers 100, 200 can switch from the clock signal included in the display data signal to the internal clock signals when the clock signal in the display data signal DD1A includes an abnormality.

Even in the case where the display data signal DD1A to the timing controller 100A and/or the display data signal DD2A to the timing controller 200A includes an abnormality, since both of the timing controllers 100A, 200A switch to the internal clocks 111A, 211A and output the signals PD1A, PD2A related to image data associated with the abnormality detection signal synchronized with the internal clocks, the problem that the abnormal signal and the normal signal are displayed together is solved and damaging the liquid crystal panel is avoided.

Figure 3:
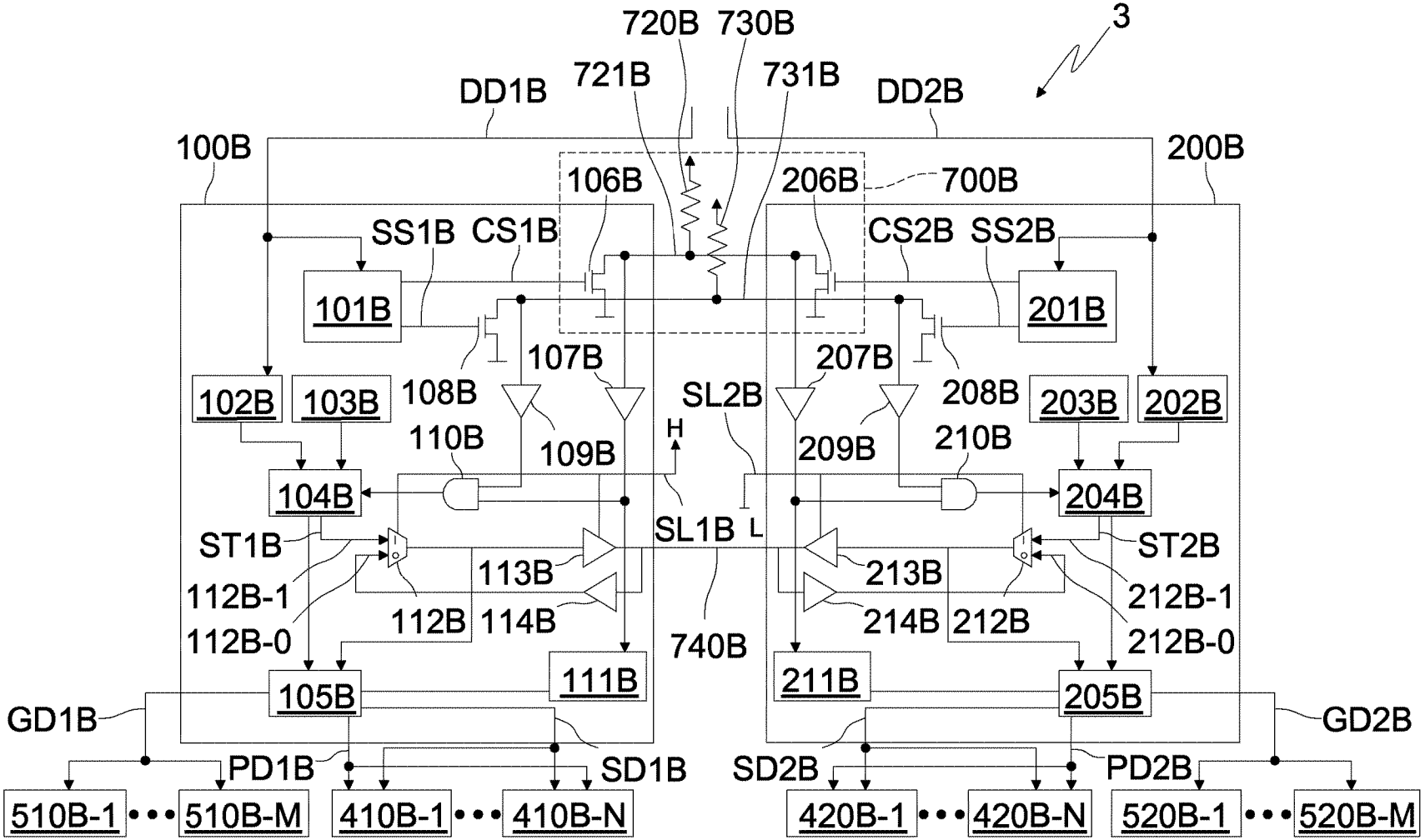
FIG. 3 is a block diagram showing a liquid crystal panel driving apparatus according to a third exemplary embodiment.
Figure 4:
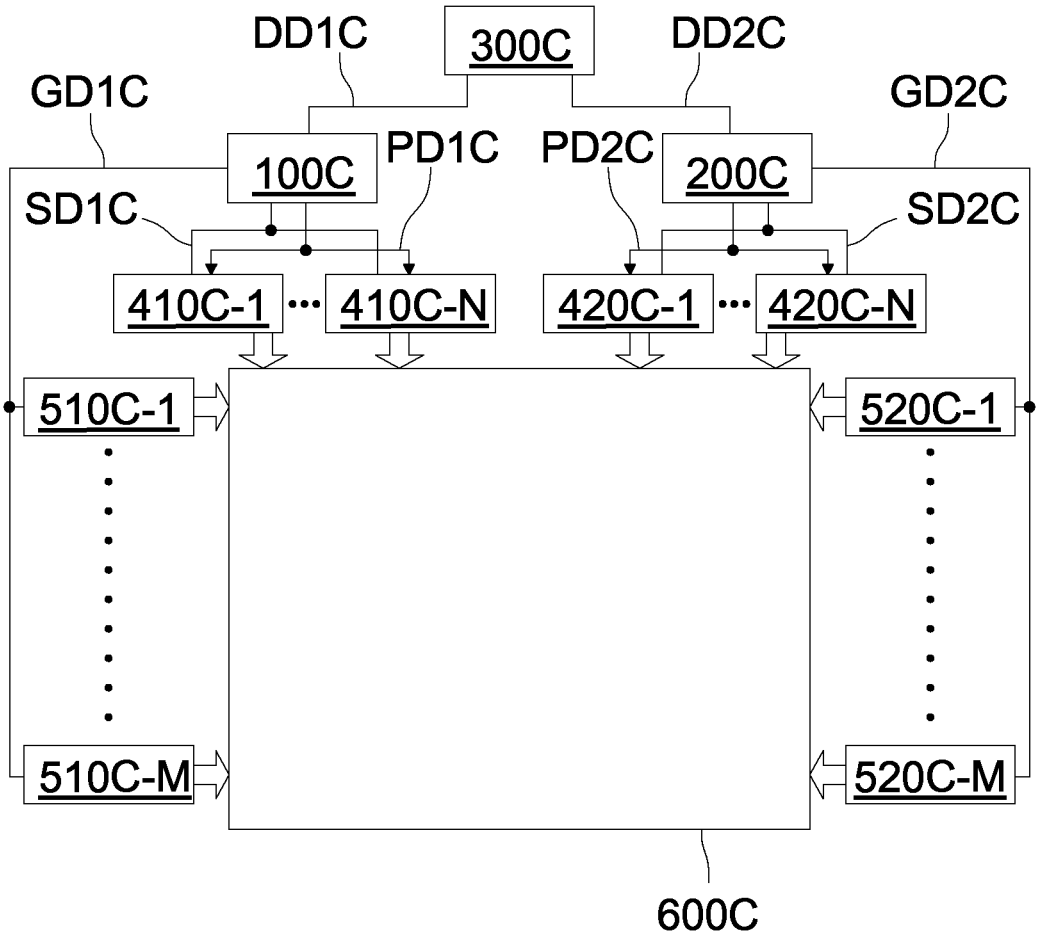
FIG. 4 PRIOR ART
FIG. 4 is a block diagram showing a conventional liquid crystal panel and driving apparatus.

FIG. 3 is a block diagram showing a liquid crystal driving apparatus 3 according to a third exemplary embodiment. In general, liquid crystal driving apparatus 3 operates in a manner similar to the previously described liquid crystal driving apparatuses 1, 2.

The image-switching unit 104B generates and outputs a high level pulse signal to the output control unit 105B every time the image-switching unit 104B starts to output one line of the image data stored in the line memory 102B or one line of the image data associated with the abnormality detection signal stored in the image data memory 103B to the output control unit 105B. Hereinafter, the pulse signal is referred to as a start signal ST1B.

One input 112B-1 of a selector 112B is provided with the start signal ST1B. An output of the buffer 114B is connected to the other input 112B-0 of the selector 112B. The selector 112B selects input 112B-1 when the high level signal is inputted to the input signal selection terminal of the selector 112B, and selects the input 112B-0 in the case where the low level signal is inputted thereto. In this exemplary embodiment, a select signal SL1B fixed at the high level is provided to the input signal selection terminal of the selector 112B and the start signal ST1B is outputted from thereof. The output of the selector 112B is connected to an input of a buffer 113B and the output control unit 105B.

An output of the buffer 113B is connected to one end of a start signal transmission line 740B. The buffer 113B switches to an enable state when the high level signal is inputted to an enable terminal of the buffer 113B, and switches to a disable state when the low level signal is inputted to the enable terminal of the buffer 113B. In FIG. 3, the select signal SL1B fixed at the high level is inputted to the enable terminal and the buffer 113B is in the enable state. The start signal ST1B from the selector 112B is transmitted to the timing controller 200B via buffer 113B and the start signal transmission line 740B.

An input of a buffer 114B is connected to one end of a start signal transmission line 740B, and a start signal ST2B from the timing controller 200B is provided to the other input 112B-0 of the selector 112B.

The image-switching unit 204B included in the timing controller 200B generates and outputs a start signal ST2B, similar to the image-switching unit 104B.

One input 212B-1 of a selector 212B is provided with the start signal ST2B. An output of a buffer 214B is connected to the other input 212B-0 of the selector 212B. The selector 212B selects the input 212B-1 when the high level signal is inputted to the input signal selection terminal of the selector 212B, and selects the input 212B-0 when the low level signal is inputted thereto. In this exemplary embodiment, a select signal SL2B fixed at the low level is provided to the input signal selection terminal of the selector 212B. The start signal ST1B transmitted from the timing controller 100B through the start signal transmission line 740B is outputted from the selector 212B. The output of the selector 212B is connected to an input of a buffer 213B and an output control unit 205B.

An output of the buffer 213B is connected to one end of the start signal transmission line 740B. The buffer 213B switches to the enable state when the high level signal is inputted to the enable terminal of the buffer 213B, and switches to the disable state when the low level signal is inputted thereto. In this exemplary embodiment, the enable terminal is provided with the select signal SL2B, which is fixed at the low level, and the buffer 213B remains in the disable state. Thus, the selector 212B does not output the start signal ST2B.

An input of buffer 214B is connected to one end of the start signal transmission line 740B and provides the other input 212B-0 of the selector 212B with start signal ST1B from the timing controller 1000B.

In this exemplary embodiment, processes for detecting a clock abnormality and a synchronization abnormality by the abnormality detection units 101B and 201B are generally the same as in the second exemplary embodiment.

The image-switching unit 104B provides one input 112B-1 of the selector 112B with the start signal ST1B. In the start signal ST1B, a high level pulse appears every time the image switching unit 104B starts to output one line of the image data stored in the line memory 102B or the image data associated with the abnormality detection signal stored in the image data memory 103B to the output control unit 105B.

Since the input signal selection terminal of the selector 112B is provided with the selected signal SL1B fixed at the high level and the input 112B-1 is selected, the output of the selector 112B outputs the start signal ST1B. The start signal ST1B from the selector 112B is provided to the output control unit 105B and is also transmitted to the timing controller 200 through the start signal transmission line 740B.

The start signal ST1B transmitted through the start signal transmission line 740B is inputted to the input 212B-0 of the selector 212B via buffer 214B. Since the input signal selection terminal of the selector 212B is provided with the selection signal SL2B fixed at the low level and the input 212B-0 is selected, the output of the selector 212B outputs the start signal ST1B. Furthermore, since the buffer 213B is in the disable state, the start signal ST1B is not provided to the start signal transmission line 740B.

The output control unit 105B starts to output the source driver control signal SD1B, the image data signal PD1B, and the gate driver control signal GD1B from the image switching unit 104B upon receiving the high level pulse of the start signal ST1B. At the same time, the output control unit 205B starts to output the source driver control signal SD2B, the image data signal PD2B, and the gate driver control signal GD2B, from the image switching unit 204B upon receiving the high level pulse of the start signal ST1B.

In the third exemplary embodiment, the timing controller 100B generates the start signal ST1B, provides the output controller 105B of the timing controller 100B with the start signal ST1B, and also transmits the start signal ST1B to the output controller 205B of the timing controller 200B through the start signal transmission line 740B. The high level pulse of the start signal ST1B causes both of the output control units 105B and 205B to output the image data signals PD1B, PD2B, for each line. Since both of the output control units 105B, 205B can synchronize the output timing of the image data signals PD1B and PD2B, an abnormality of the display and damage of the liquid crystal panel due to the unsynchronized output timing can be prevented.

The case where the start signal ST1B generated by the timing controller 100B is transmitted to the timing controller 200B through the transmission line 740B is explained above. The start signal ST2B generated by the timing controller 200B can be transmitted to the timing controller 100B through the start signal transmission line 740B. This can be accomplished by fixing the select signal SL1B at the low level and fixing the select signal SL2B at the high level.

The first, second, and third exemplary embodiments each include two timing controllers; however, a liquid crystal driving apparatus may include three or more timing controllers. In such a device, the similar effects can be achieved by connecting each of timing controllers using the abnormality detection line and the start signal transmission line connected to the pull-up resistors, as in the above-described exemplary embodiments.

While exemplary embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages of the may exist even though they may not have been explicitly discussed herein.

What is claimed is:

1. A liquid crystal panel driving apparatus comprising:

a plurality of timing controllers, each of the plurality of the timing controllers including a line memory for storing image data included in a received display data signal and an output controller unit that provides a liquid crystal panel driver with a driving signal based on the image data stored in the line memory and the display data signal;

wherein each of the plurality of the timing controllers includes an abnormality detection unit for outputting an abnormality detection signal when an abnormality in the display data signal is detected, an abnormality detection signal transmission unit for transmitting the abnormality detection signal to at least one other of the timing controllers, an image data memory for storing image data associated with the abnormality detection signal, and an image switching unit that provides the output control unit with the image data associated with the abnormality detection signal stored in the image data memory instead of the image data stored in the line memory when an abnormality is detected.

2. The apparatus of claim 1, wherein the abnormality detection signal transmission unit is an open drain circuit including a gate input adapted to receive the abnormality detection signal, a drain output adapted to transmit the abnormality detection signal to at least one other of the timing controllers via an abnormality detection line which is connected to a pull-up resistor, and a source common connected to a reference voltage.

3. The apparatus of claim 2, wherein the drain output of the drain output circuit included in one of the timing controllers and the drain output of the drain output circuit included in another one of the timing controllers are connected to each other through the abnormality detection line connected to the pull-up resistor.

4. The apparatus of claim 1, wherein the output control unit provides the liquid crystal panel driver with the image data synchronized with a clock signal included in the display data signal, the abnormality detection signal includes a clock abnormality detection signal for indicating a detection of an abnormality in the clock signal and a synchronization abnormality detection signal for indicating a detection of an abnormality in a synchronization signal, and the image switching unit provides the output control unit with the clock abnormality detection signal with the image data associated with the abnormality detection signal upon receiving one or both of the clock abnormality detection signal and the synchronization detection signal.

5. The liquid crystal driving apparatus of claim 4, wherein each of the timing controllers includes a clock switching unit operative to select an internal clock signal instead of the clock signal included in the display data signal upon receipt of the clock abnormality detection signal, and the output control unit provides the liquid crystal panel driver with the image data associated with the abnormality detection signal synchronized with the internal clock signal.

6. The liquid crystal driving apparatus of claim 1, wherein the image switching unit includes a start signal generating circuit operative to generate a start signal, a start signal transmitting circuit operative to transmit the start signal to another of the timing controllers, and the output control unit starts to provide the liquid crystal panel driver with the image data upon receipt of the start signal.

7. The liquid crystal driving apparatus of claim 6, further comprising a selector for selecting any one of a start signal generated by the image-switching unit included in the timing controller generating the start signal or start signals received from another timing controller, wherein the output control unit starts to provide the image data upon receipt of the start signal selected by the selector.

* * * * *